United States Patent [19]

Schaefer et al.

[11] Patent Number: 5,074,945

[45] Date of Patent: Dec. 24, 1991

[54] PROCESS AND DEVICE FOR PRODUCING A COHERENT WEB FROM LONG SLIVERS

[75] Inventors: Gerd Schaefer, St. Nom-la-Breteche, France; Karl Schaefer, Lechbruck am See, Fed. Rep. of Germany

[73] Assignee: Inter-Wood-Maschinen G.m.b.H. & Co. KG, Lechbruck am See, Fed. Rep. of Germany

[21] Appl. No.: 530,576

[22] Filed: May 30, 1990

[30] Foreign Application Priority Data

May 30, 1989 [DE] Fed. Rep. of Germany ..... 3917452

[51] Int. Cl.[5] ..... B27L 11/00

[52] U.S. Cl. ..... 156/264; 156/256; 156/259; 156/512; 156/517; 83/870; 83/871; 83/874; 144/3 K; 144/346; 144/352; 144/366; 144/369

[58] Field of Search ..... 156/264, 259, 256, 512, 156/517, 62.2, 62.4, 62.6, 62.8; 144/346, 352, 340, 3 K, 366, 369; 83/870, 871, 874, 102.1; 241/280, 281, 283; 162/286, 194, 20

[56] References Cited

U.S. PATENT DOCUMENTS

| | | | |
|---|---|---|---|
| 3,674,219 | 7/1972 | Harvey, Jr. | 241/152 R |
| 4,122,236 | 10/1978 | Holman | 156/62.2 X |
| 4,232,067 | 11/1980 | Coleman | 144/352 X |
| 4,337,809 | 7/1982 | Bertolette et al. | 144/3 K X |
| 4,371,020 | 2/1983 | Barnes et al. | 144/3 K X |
| 4,421,149 | 12/1983 | Barnes et al. | 144/3 K X |
| 4,711,684 | 12/1987 | Coleman | 156/264 X |
| 4,818,321 | 4/1989 | Shimizu et al. | 144/366 X |

FOREIGN PATENT DOCUMENTS

| | | |
|---|---|---|
| 2600948 | 7/1977 | Fed. Rep. of Germany . |
| 2716748 | 11/1977 | Fed. Rep. of Germany . |
| WO 85/02366 | 6/1985 | World Int. Prop. O. . |
| WO 85/02367 | 6/1985 | World Int. Prop. O. . |
| WO 85/02368 | 6/1985 | World Int. Prop. O. . |
| WO 85/02369 | 6/1985 | World Int. Prop. O. . |
| WO 85/02370 | 6/1985 | World Int. Prop. O. . |

*Primary Examiner*—David A. Simmons
*Assistant Examiner*—J. Sells
*Attorney, Agent, or Firm*—Foley & Lardner

[57] ABSTRACT

The invention relates to a process and to a device for producing a coherent web from long slivers which are produced by breaking-up the raw material fed and are then compacted to give a web which is subsequently glued and then pressed together with other webs to give blocks or the like. The raw material used is sticks or slabs which are split parallel to the fibers by vertically oscillating cutting motions, to give long slivers which are then compacted by ramming to give a web.

35 Claims, 3 Drawing Sheets

Fig.3
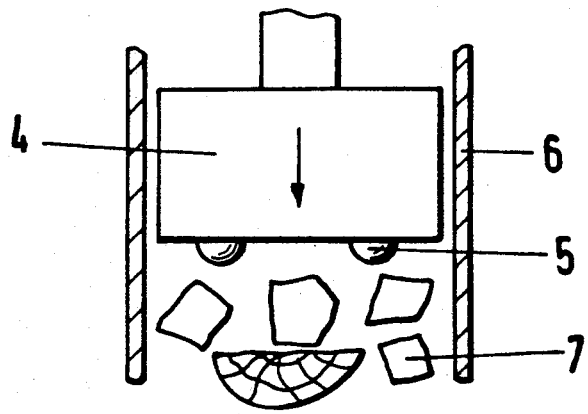
Fig.4
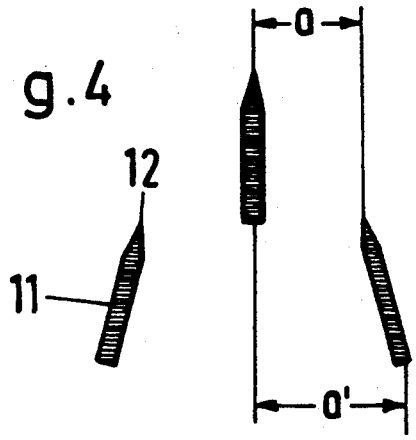
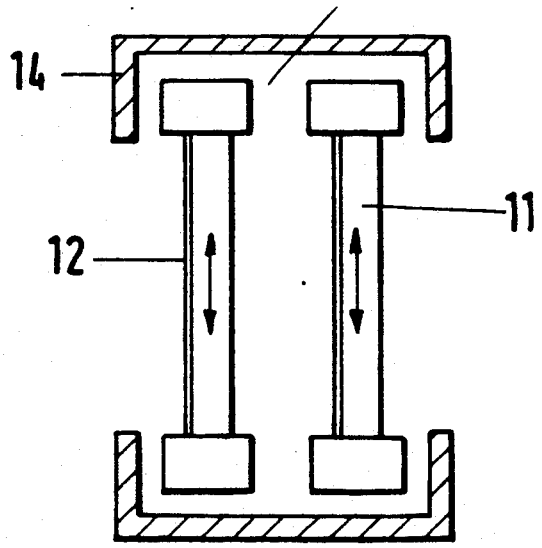
Fig.5

PROCESS AND DEVICE FOR PRODUCING A COHERENT WEB FROM LONG SLIVERS

BACKGROUND OF THE INVENTION

1. Field of the Invention

The invention relates to a process and to a device for producing a coherent web from long slivers which are produced by breaking-up the raw material fed and are then compacted to give a web. Those webs can subsequently glued and then pressed together with other webs to give blocks or the like.

2. Description of the Prior Art

A corresponding process and equipment types for carrying out the process are to be found, for example, in German Offenlegungsschrift 2,716,748. In this case, a compressed wood product is created which, as distinct from conventional chipboards, is composed of long slivers which are arranged largely with their fibers mutually parallel. The raw material used is natural wood which is subjected to crushing rollers in such a way that the wood disintegrates parallel to the fibers to give a still coherent web. To assist this crush disintegration, longitudinal notches or the like can be made from above in the natural wood.

The production of such crush wood was described for the first time in Holz-Zentralblatt, Stuttgart, No. 11 of Jan. 25, 1967 (Article "Quetschholz—ein neuer Rohstoff für die Zellstoffindustrie [Crushwood-a new raw material for the pulp industry]"). Further publications relating to this product are PCT-WO 85/02,366, WO 85/02,367, WO 85/02,368, WO 85/02,369 and WO 85/02,370. U.S. Pat. No. 3,674,219 also appears to be comparable.

The crushing of the wood, common to this state of the art, for loosening its fiber structure and for producing a mat of wood fiber sections still firmly joined to one another appears to be disadvantageous in several respects but, above all, requires a very high energy consumption.

SUMMARY OF THE INVENTION

It is an object of the present invention to provide an improved process for producing the webs described at the outset.

A further object of the invention resides in the provision of an improved device for producing said webs.

In accomplishing the foregoing objects, there has been provided according to one aspect of the present invention a process for producing a coherent web comprising the steps of: aligning sticks or slabs approximately parallel in the longitudinal direction side by side and in superposition and dressing the sticks or slabs to produce a continuous packet strand of approximately equal width and height; advancing the packet strand approximately horizontally in the longitudinal direction of the sticks or slabs and subjecting the packet strand at the same time to pressure forces from above; breaking-up the individual sticks or slabs in the longitudinal direction by vertical cutting motions at a frequency sufficient to produce individual long slivers which are mutually separate parallel to the fibers, the packet strand decreasing in height but increasing in width; and compacting the long slivers into a web by a ramming action on the long slivers from above.

According to another aspect of the present invention, there has been provided a device for producing a coherent web comprising: a conveyor for transporting a continuous packet strand which includes longitudinally aligned sticks or slabs; a pressing device arranged above the conveyor, extending across the conveyor width, acting vertically downwardly and rolling on the packet strand; a breaking-up device downstream of the conveyor, including a plurality of rows of knives being aligned transversely to the direction of conveying and arranged with an offset behind one another and relative to one another, each of the rows of knives being composed of a plurality of splitting knives arranged side by side at a distance, and being guided to be vertically displaceable, and means for driving the knives at a frequency of oscillation sufficient for splitting said sticks or slabs generally longitudinally into long slivers; and a compacting device provided downstream of the breaking-up device, in which the previously split long slivers are compacted to produce a web.

Further objects, features and advantages of the invention will be apparent from the detailed description of preferred embodiments that follows, when considered with the attached figures of drawing.

BRIEF DESCRIPTION OF THE DRAWINGS

Some embodiments of the invention serving as examples are diagrammatically represented in the drawing in which:

FIG. 3 shows, on an enlarged scale as compared with FIG. 1, a pressing device in end view and partially in cross-section, FIG. 4 shows a detail of FIG. 2 on an enlarged scale and in a modified embodiment, and FIG. 5 shows, on an enlarged scale as compared with FIG. 1, a detail of FIG. 1 in a modified embodiment.

DETAILED DESCRIPTION OF THE PREFERRED EMBODIMENTS

Figure 1:
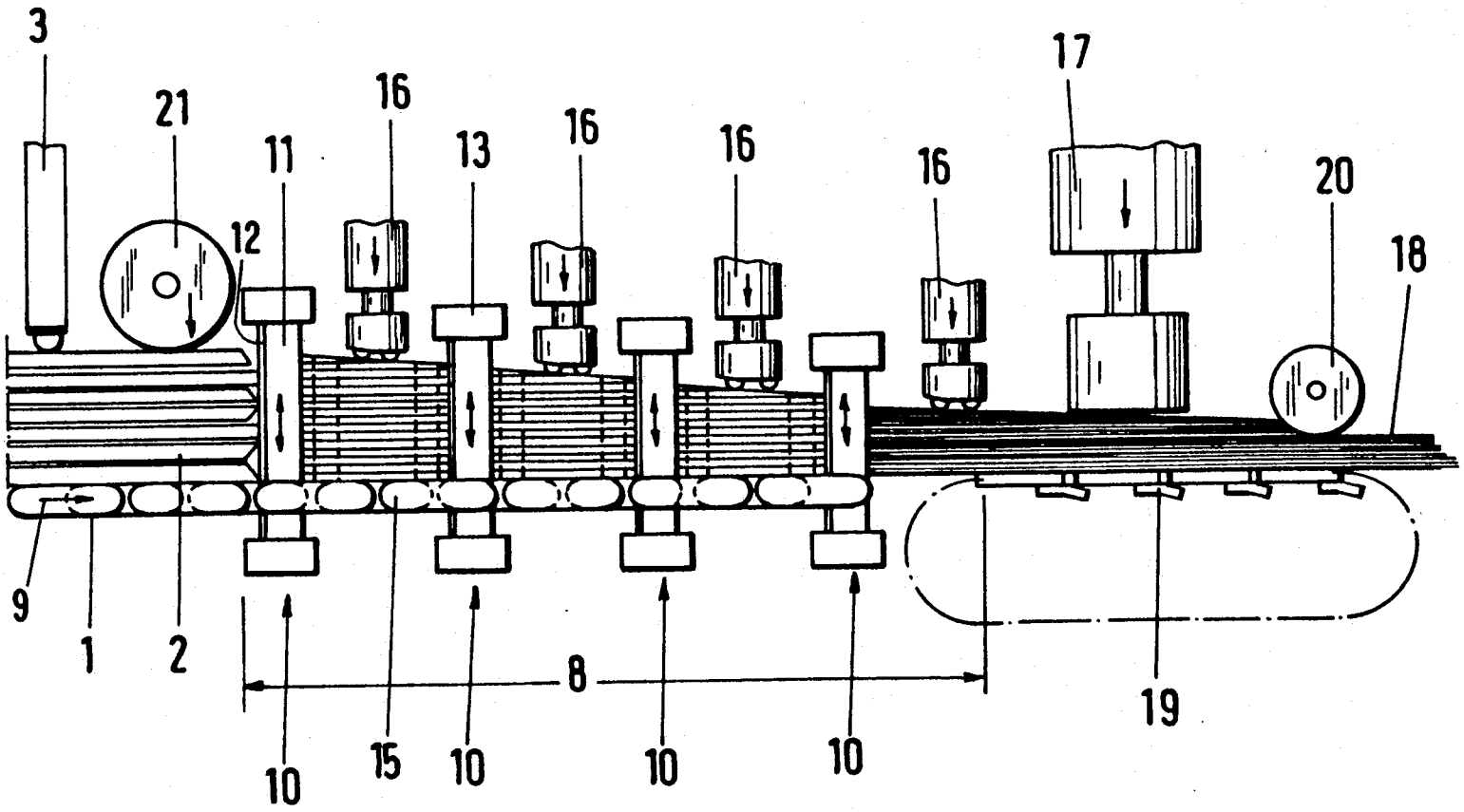
FIG. 1 shows a unit for producing a web from long slivers, in side view.

The process according to the present invention includes the following process steps:

a) the raw material used is sticks or slabs which are aligned approximately parallel in the longitudinal direction side by side and in superposition and are dressed to give a continuous packet strand of approximately equal width and height, b) this packet strand is advanced approximately horizontally in the longitudinal direction of the sticks or slabs and at the same time subjected to pressure forces from above, in order to prevent yielding during the subsequent breaking-up, c) the packet strand is then passed through a breaking-up device in which the individual sticks or slabs are broken up in the longitudinal direction by vertical cutting motions in a short time cycle to give individual long slivers which are mutually separate parallel to the fibers, the packet strand decreasing in height but increasing in width, and d) these long slivers are then compacted into a web by ramming which acts on them from above.

According to the invention, sticks and, if appropriate, slabs are used as the raw material instead of solid wood. Whereas previous barking of the raw material is required in conventional processes, this is not necessary according to the invention. The energy-intensive crushing step is replaced according to the invention by a splitting step parallel to the fibers. In contrast to the prior processes, the fiber structure is thus not only loosened according to the invention to give a mat in which the fiber sections are still firmly coherent, but the raw material layered in superposition is split into individual longitudinal slivers which are thus completely separated from one another and the cross-sections of which should preferably be on average 100 $mm^2$ and at most 200 $mm^2$. Admittedly, "cutting motions" are mentioned; however, these should preferably be carried out, in conjunction with the preferably continuous advance of the packet strand, in such a way that a splitting process results in the wood material, that is to say the knife edge is preceded in the wood by an air gap.

The sticks or slabs can already be combined into individual bundles in the saw mill, before they are processed, and detached from these bundles to form this continuous packet strand. In this case, it is advantageous if the packet strand is dressed to a height which is considerably smaller than the diameter of a bundle.

On their way between the individual cutting steps, the sticks or slabs are subjected from above to pressure forces advancing them, for firm compression of the raw material layered in superposition while it is broken up longitudinally.

Due to the longitudinal division of the sticks or slabs owing to the repeated longitudinal splitting, internal stresses in the wood are relieved, and a fabric-like mat formed of long slivers lying loosely side by side and in superposition results. This mat-like structure is then compacted to give a web by the ramming provided according to the invention. The pressure of the rams can here be adjusted such that the fiber structure is loosened in a preselectable manner, which is not achievable by means of crush rollers.

In order to further enhance the mutual matting of the long slivers during the formation of the fabric, it can be advantageous when the long slivers are guided on paths which cross at acute angles. This further assists the splaying effect which already results from the longitudinal splitting during which the long slivers formed from a stick are slightly deflected on both sides from the original conveying direction by the splitting knife dividing them longitudinally, so that different directions then result.

In principle, it is possible to carry out longitudinal splits in a short time cycle by means of splitting knives whose cutting edges are aligned horizontally and parallel to the fibers. However, longitudinal splits which are made by vertically oscillating cutting motions of splitting knives, the cutting edges of which are at least approximately vertical, so that the splitting takes place against the advancing direction of the wood, have proven more advantageous and in particular more energy-saving.

A particular advantage of the process according to the invention is that sticks and, if appropriate, slabs are processed, which normally can be layered in several superposed plies, instead of round timber. Raw material of any desired length can therefore be used, whereas round timber cut to lengths is required in the state of the art. Another advantage is that, in the process according to the invention, controllable advancing and cutting forces can be applied. The bonding of the individual, first produced long slivers to give a transportable coherent web takes place according to the invention exclusively by the application of pressure. Any bark is separated off or crumbled during the longitudinal breaking-up of the sticks or slabs and can therefore be removed without problems.

If the sticks or slabs are combined into bundles before they are processed, it is advantageous when the packet strand is then dressed to a height which is considerably smaller than the diameter of a bundle.

According to the invention, the oscillation of the cutting motions to produce the long slivers can be up to 80 cycles/second. For the subsequent formation of the web, it is advantageous when the ramming acting from above on the long slivers or on the mesh for the compaction thereof exerts a sudden, abrupt action of a large force, stored energy being converted within milliseconds, without large kinetic energies having to be evolved. The web compressed in this way can then be subjected to thickness dressing.

The packet strand or the mesh can be advanced continuously at constant speed. This leads, inter alia, to backing-up of material before the discontinuously operating ramming, in conjunction with upsetting of the long slivers which burst open in the manner of the eye of a needle under the action of this force. As a result, the matting is improved, and the said effect is controllable.

The device according to the present invention includes the following features:

a) a conveyor for a continuous packet strand consisting of longitudinally aligned sticks or slabs, b) a pressing device arranged above this conveyor, extending across the conveying width, acting vertically downwards and rolling on the packet strand, c) a breaking-up device downstream of the conveyor, consisting of a plurality of rows of knives which are aligned transversely to the direction of conveying and are arranged with an offset behind one another and relative to one another and which are each composed of a plurality of splitting knives which are arranged side by side at a clear distance, are guided to be vertically displaceable and are subject to a drive of short cycle time, and d) downstream of the breaking-up device, a compacting device is provided in which the previously split long slivers are compacted to give a web.

It can here be additionally advantageous if, within the breaking-up device and across the increasing conveying width thereof, guide elements for deflecting the longitudinally split sticks or slabs and/or long slivers are arranged in such a way that guide paths crossing at acute angles are formed for these.

Upstream of the packet strand conveyor, a metering device can be provided for detaching the sticks or slabs from bundles fed. The pressing device upstream of the breaking-up device can preferably have pressing rolls and/or pressing balls which can be actuated via mutually linked hydraulic cylinders, the pressing rolls preferably having floating mounts. This gives optimized adaptation of the pressing device to the surface contour of the packet strand.

In order to improve or ensure the parallel guiding of the sticks or slabs, the pressing device upstream of the breaking-up device can have contact pressure blocks with guide strips.

To avoid jamming of the sticks or slabs between the splitting knives, it is advantageous if the distance between the cutting edges of two splitting knives arranged side by side in one row is smaller than that between the rear knife edges.

The contact pressure devices provided in the breaking-up device can also comprise freely rotating pressing rolls in floating mounts. To prevent the vertically arranged splitting knives from pulling up the sticks or slabs, being acted upon at the time, with them during their upward motion, it can be advantageous if the splitting knives are arranged with an inclination against the conveying direction and thereby enclose an acute angle with the latter.

The compacting device downstream of the breaking-up device can be composed of a plurality of power units which convert the energy stored in them within milliseconds in a rapid time cycle. It is advantageous here if, both for the oscillating drive of the splitting knives and for the drive of the compacting device, power units are used such as are described in German Patent Specification 2,600,948.

Referring now to the drawings, the unit shown in FIG. 1 starts with a conveyor 1 for a continuous packet strand 2 consisting of longitudinally aligned sticks or slabs. Above the conveyor 1, a pressing device 3 is located which extends across the conveying width and acts vertically downwards on the upper side of the packet strand 2 and rolls on the latter. FIG. 3 shows a contact pressure block 4 of this pressing device 3, having pressing rolls 5 and/or pressing balls as well as guide strips 6 for improving the parallel guiding of the sticks 7 or slabs.

Downstream of the pressing device 3, a breaking-up device 8 is provided which has a plurality of rows of knives 10 which are aligned transversely to the conveying direction 9 and arranged with an offset behind one another and relative to one another and which are each composed of a plurality of splitting knives 11 arranged side by side at a clear distance, with vertical cutting edges 12 directed against the packet strand 2. The splitting knives 11 are guided to be vertically displaceable and are subjected to an oscillating drive 13. At least the splitting knives 11 of one row of knives 10 are arranged here in a common frame 14 (see FIG. 5) which frame is subject to the oscillating drive 13 which is not shown in more detail. The conveyor transporting the packet strand 2 through the breaking-up device 8 is formed by driven chains 15 which are taken through between the splitting knives 11 and are in an interleaved arrangement. In the breaking-up device 8, between the individual rows of knives 10, contact pressure devices 16 are located which again can have pressing rolls and/or pressing balls and firmly compress the packet strand 2 from above on the way through the breaking-up device 8.

Downstream of the breaking-up device 8, a compacting device 17 is provided in which the previously split long slivers are compacted to give a web 18. As a conveyor for the web 18, there is a flat belt 19 downstream of the breaking-up device 8. A dressing roller 20 is provided downstream of the compacting device 17.

Figure 2:
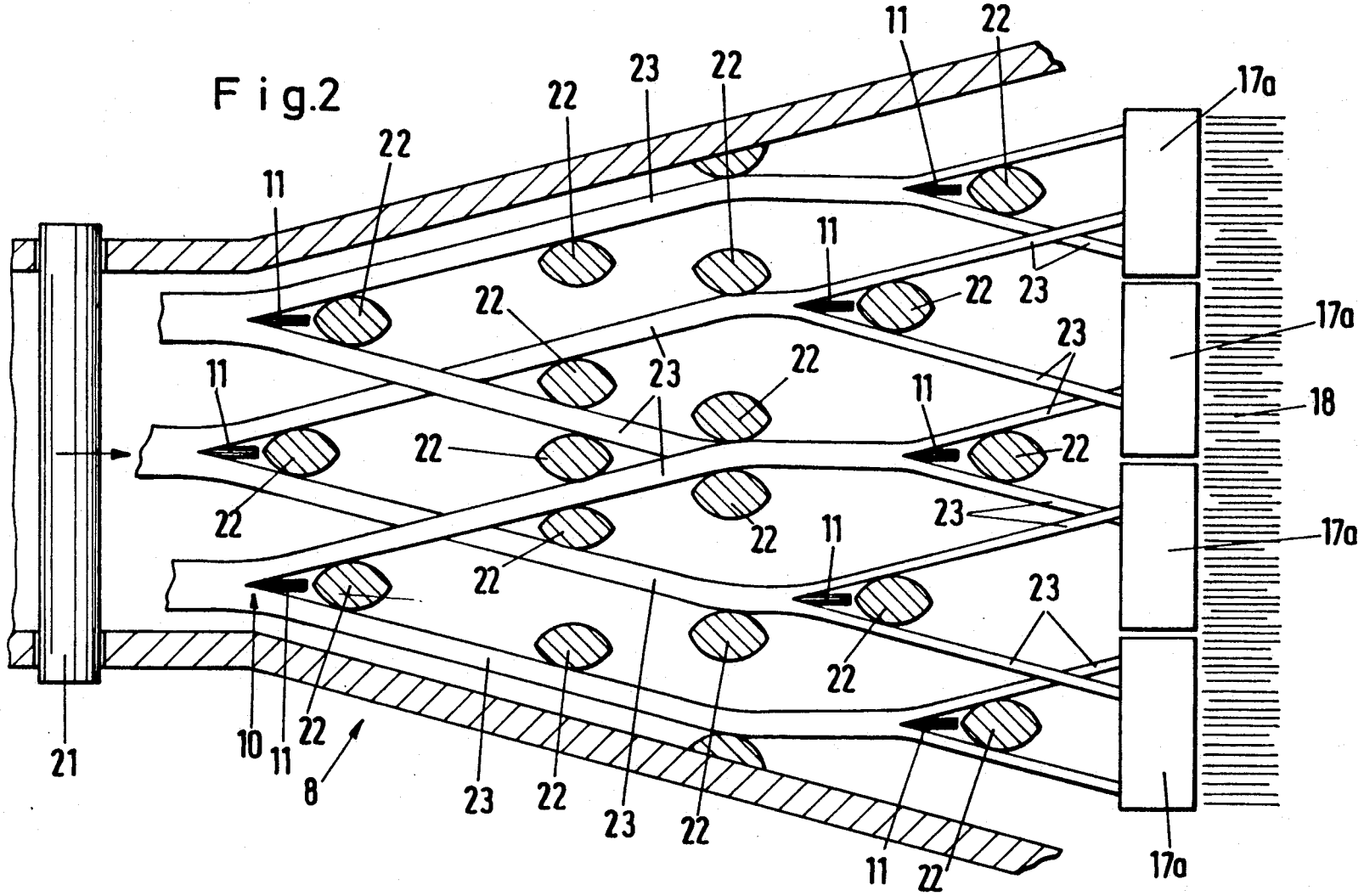
FIG. 2 shows, on an enlarged scale, a unit section according to FIG. 1 in plan view and partially in horizontal section.

FIG. 2 shows the region of the breaking-up device 8, the contact pressure devices 16 provided between the rows 10 of knives not being shown to improve clarity. In the region of this breaking-up device 8 (and downstream in the region of the compacting device 17 and the dressing roller 20), the packet strand 2 decreases in height but increases in width. A dressing roll 21 is provided upstream of the breaking-up device 8, and the compacting device 17 composed of a plurality of power units 17a is provided downstream. Within the breaking-up device 8 and across the increasing conveying width thereof, guide elements 22 for deflecting the longitudinally split sticks or slabs and/or long slivers are arranged in such a way that guide paths 23 crossing at acute angles are formed for these.

In FIG. 4, it can be seen that the distance (a) between the cutting edges 12 of two splitting knives 11 arranged side by side in a row 10 is smaller than the distance (a') between the rear knife edges. The thickness of the knives 11 formed with a sharp cutting edge 12 is preferably 2–3 mm. The stroke of the knives can be about 200 mm.

The sticks or slabs used as the raw material are aligned side by side and in superposition approximately parallel to one another in the longitudinal direction and dressed to give the continuous packet strand 2 of approximately equal width and height. This packet strand conveyed continuously or discontinuously on the conveyor 1 is subjected to the pressing device 3 in order to prevent yielding during the subsequent breaking-up. The packet strand 2 is then transported by the chain conveyor 15 through the breaking-up device 8 in the direction of conveying 9. The front face of the packet strand 2 thus passes into the action region of the splitting knives 11 which execute vertical oscillating cutting motions and split, by their vertical cutting edges 12, the sticks or slabs against the advancing direction 9 thereof in the longitudinal direction, the result being long slivers which are separate from one another with the fibers parallel, due to the repeated longitudinal splitting. For further enhancing of the matting thereof, the guide elements 22 indicated in FIG. 2 are provided. The provision of the said guide paths 23 ensures that the long slivers cross on their way through the breaking-up device 8 and thus form a fabric which is then compacted by the downstream compacting device 17, which exerts a ramming effect from above on the fabric, to give the web 18 in which the long slivers are arranged predominantly in their longitudinal direction.

What is claimed is:

1. A process for producing a coherent web comprising the steps of:

a) aligning sticks or slabs approximately parallel in the longitudinal direction side by side and in superposition and dressing said sticks or slabs to produce a continuous packet strand of approximately equal width and height; then b) advancing said packet strand approximately horizontally in the longitudinal direction of the sticks or slabs and subjecting said packet strand at the same time to pressure forces from above; then c) breaking-up the individual sticks or slabs in the longitudinal direction by vertical cutting motions at a frequency sufficient to produce individual long slivers which are mutually separate and parallel to the fibers, the packet strand decreasing in height but increasing in width; and then d) compacting said long slivers into a web by a ramming action on said long slivers from above.

2. The process of claim 1, wherein said step b) comprises the step of advancing said sticks or slabs via a conveyor while simultaneously imposing pressure on said packet strand from above the conveyor.

3. A process for producing a coherent web comprising the steps of:

a) aligning sticks or slabs approximately parallel in the longitudinal direction side by side and in superposition and dressing said sticks or slabs to produce a continuous packet strand of approximately equal width and height;

b) advancing said packet strand approximately horizontally in the longitudinal direction of the sticks or slabs and subjecting said packet strand at the same time to pressure forces from above;

c) breaking-up the individual sticks or slabs in the longitudinal direction by vertical cutting motions at a frequency sufficient to produce individual long slivers which are mutually separate and parallel to the fibers, the packet strand decreasing in height but increasing in width;

d) moving the long slivers on paths crossing at acute angles to form a mesh; and e) compacting said long slivers into a web by a ramming action on said long slivers from above.

4. The process as claimed in claim 3, wherein long slivers are produced having a cross-section of at most about 200 $mm^2$.

5. The process as claimed in claim 3, wherein the individual sticks or slabs are split into long slivers against said direction of advance by vertically oscillating cutting motions.

6. The process as claimed in claim 5, further comprising, before processing, the steps of combining the sticks or slabs into individual bundles and detaching said sticks or slabs from these bundles to form the continuous packet strand.

7. The process as claimed in claim 6, wherein the packet strand is dressed to a height which is considerably smaller than the diameter of a bundle.

8. The process as claimed in claim 5, wherein the packet strand or its sticks or slabs are subjected successively to a plurality of vertically oscillating cutting motions.

9. The process as claimed in claim 8, wherein the frequency of oscillation of the cutting motions is up to about 80 cycles/second.

10. The process as claimed in claim 8, wherein the sticks or slabs are subjected from above to pressure forces promoting the advance of said sticks or slabs when said sticks or slabs are being passed between individual cutting motions of said plurality of cutting motions.

11. The process as claimed in claim 10, wherein said ramming exerts a sudden, abrupt action of a large force, with stored energy being converted within milliseconds, without large kinetic energies having to be evolved.

12. The process as claimed in claim 11, wherein the compressed web is further subjected to thickness dressing.

13. The process as claimed in claim 12, wherein unbarked raw material is used.

14. The process as claimed in claim 10, wherein, the sticks or slabs include bark and said bark is separated off and removed when said sticks or slabs are broken up.

15. The process as claimed in claim 3, wherein the packet strand is supported while being transported through the breaking-up step.

16. Device for producing a coherent web comprising:

a) a conveyor for transporting a continuous packet strand which includes longitudinally aligned sticks or slabs;

b) a pressing device arranged above said conveyor, extending across the conveyor width, acting vertically downwardly and rolling on the packet strand;

c) a breaking-up device arranged downstream of the conveyor, including a plurality of rows of knives being aligned transversely to the direction of conveyance and arranged with an offset behind one another and relative to one another, each of said rows of knives being composed of a plurality of splitting knives arranged side by side at a distance, and being guided to be vertically displaceable, and means for driving said knives at a frequency of oscillation sufficient for splitting the sticks or slabs generally longitudinally into long slivers; and d) a compacting device provided downstream of the breaking-up device, in which the previously split long slivers are compacted to produce a web.

17. Device for producing a coherent web comprising:

a) a conveyor for transporting a continuous packet strand which includes longitudinally aligned sticks or slabs;

b) a pressing device arranged above said conveyor, extending across the conveyor width, acting vertically downwardly and rolling on the packet strand;

c) a breaking-up device arranged downstream of the conveyor, including a plurality of rows of knives being aligned transversely to the direction of conveyance and arranged with an offset behind one another and relative to one another, each of said rows of knives being composed of a plurality of splitting knives arranged side by side at a distance, and being guided to be vertically displaceable, and means for driving said knives at a frequency of oscillation sufficient for splitting the sticks or slabs generally longitudinally into long slivers;

d) a compacting device provided downstream of the breaking-up device, in which the previously split long slivers are compacted to produce a web; and e) guide elements, located within the breaking-up device and extending across an increasing conveying width thereof, for deflecting the longitudinally split long slivers, arranged in such a way that guide paths crossing at acute angles are formed for said split long slivers.

18. The device as claimed in claim 17, further comprising a metering device for detaching the sticks or slabs from bundles fed upstream of the packet strand conveyor.

19. The device as claimed in claim 18, further comprising a dressing device associated with the packet strand conveyor to form a packet strand of approximately equal width and height.

20. The device as claimed in claim 19, wherein the pressing device arranged upstream of the breaking-up device includes at least one of pressing rolls and pressing balls and means for actuating said at least one of said rolls and balls by hydraulic cylinders.

21. The device as claimed in claim 20, wherein the pressing rolls include floating mounts.

22. The device as claimed in claim 17, wherein the pressing device arranged upstream of the breaking-up device includes contact pressure blocks with guide strips for improving the parallel guiding of the sticks or slabs.

23. The device as claimed in claim 22, wherein the splitting knives are arranged at least approximately vertically with approximately vertical cutting edges directed against the packet strand.

24. The device as claimed in claim 23, wherein the splitting knives include cutting edges and rear knife edges and the distance between the cutting edges of two splitting knives arranged side by side in one row is smaller than the distance between the rear knife edges.

25. The device as claimed in claim 24, wherein at least the splitting knives of one row are arranged in a common frame which is subject to an oscillating drive.

26. The device as claimed in claim 25, wherein a portion of the conveyor passing through the breaking-up device comprises driven chains passing through the breaking-up device in between the splitting knives.

27. The device as claimed in claim 26, further comprising a flat belt conveyor for the web provided downstream of the breaking-up device.

28. The device as claimed in claim 27, wherein, in the breaking-up device between individual rows of knives of said plurality of rows of knives, contact pressure devices are arranged which firmly compress the packet strand or the mesh being formed from above on the way through the breaking-up device.

29. The device as claimed in claim 28, wherein the contact pressure devices comprise freely rotating pressure rolls in floating mounts.

30. The device as claimed in claim 29, wherein the splitting knives are arranged with an inclination against the direction of conveying and thereby form an acute angle with the latter.

31. The device as claimed in claim 30, wherein the compacting device downstream of the breaking-up device is composed of a plurality of power units which convert the energy stored in them within milliseconds in a rapid time cycle.

32. A process as claimed in claim 1, further comprising the steps of:

e) gluing said web, and f) pressing said web with at least one other web for producing a block.

33. A process as claimed in claim 15, wherein said packet strand is advanced continuously at constant speed.

34. A device as claimed in claim 17, wherein said guide elements for deflecting said sticks or slabs are arranged in such a way that guide paths are formed for said sticks or slabs.

35. A device as claimed in claim 14, wherein the splitting knives are arranged with an inclination with respect to the direction of conveying and thereby form an acute angle with the latter.

* * * * *